US005890496A

United States Patent [19]

Habibi

[11] Patent Number: 5,890,496

[45] **Date of Patent: *Apr. 6, 1999**

[54] HEATABLE HAIR CURLER WITH ADJUSTABLE DIAMETER

[76] Inventor: Masood Habibi, P.O. Box 71104, Los Angeles, Calif. 90071

[ * ] Notice: The term of this patent shall not extend beyond the expiration date of Pat. No. 5,694,954.

[21] Appl. No.: 889,240

[22] Filed: Jul. 8, 1997

Related U.S. Application Data

[63] Continuation-in-part of Ser. No. 540,791, Oct. 11, 1995, Pat. No. 5,694,954, and a continuation-in-part of Ser. No. 540, 790, Oct. 11, 1995, Pat. No. 5,662,128.

[51] Int. Cl.[6] ..... A45D 7/00

[52] U.S. Cl. ..... 132/210; 132/203; 132/222; 132/223; 132/247

[58] Field of Search ..... 132/222, 229, 132/233, 246, 269, 245, 251, 264, 210, 211

[56] References Cited

U.S. PATENT DOCUMENTS

| | | | |
|---|---|---|---|
| 1,892,107 | 12/1932 | Jancke et al. | 132/229 |
| 1,894,431 | 1/1933 | Vaghelatos | 132/229 |
| 1,926,987 | 9/1933 | Durham et al. | 132/222 |
| 1,957,049 | 5/1934 | Lakenbach | 132/222 |
| 2,720,207 | 10/1955 | Burtnett | 132/246 |
| 3,108,603 | 10/1963 | Mobberley | 132/222 |
| 3,232,300 | 2/1966 | Fisher | 132/245 |
| 3,523,542 | 8/1970 | Eisler | 132/33 |
| 3,590,829 | 7/1971 | Parisi | 132/43 |
| 3,871,388 | 3/1975 | Leoci | 132/9 |
| 4,022,225 | 5/1977 | Kauffman | 132/31 |
| 4,022,226 | 5/1977 | Muenstermann | 132/245 |
| 4,270,555 | 6/1981 | Punte | 132/40 |
| 4,456,020 | 6/1984 | van Deursen | 132/34 |
| 4,524,788 | 6/1985 | Pauldine | 132/42 |
| 4,584,462 | 4/1986 | Morrison | 219/222 |
| 4,714,820 | 12/1987 | Morrison et al. | 219/222 |
| 4,856,542 | 8/1989 | Hollenberg et al. | 132/265 |
| 4,911,186 | 3/1990 | Hayden | 132/246 |
| 5,000,200 | 3/1991 | Roberts | 132/245 |
| 5,020,552 | 6/1991 | Hollenberg et al. | 132/265 |
| 5,024,244 | 6/1991 | Brown | 132/270 |
| 5,186,187 | 2/1993 | Roberts | 132/245 |
| 5,293,884 | 3/1994 | Chapman et al. | 132/200 |
| 5,294,777 | 3/1994 | Denhup | 219/225 |
| 5,411,040 | 5/1995 | Forrest | 132/211 |

*Primary Examiner*—Cary E. O'Connor
*Assistant Examiner*—Pedro Philogene
*Attorney, Agent, or Firm*—D'Alessandro & Ritchie

[57] ABSTRACT

An adjustable hair curler includes a thin sheet of a flexible resilient material. A coating on a first side of the resilient sheet includes a soft material for contacting and gripping the hair. A coating is also applied to the second opposite side of the resilient sheet. The coatings are able to withstand repeated heat cycling. Application of heat from a heat source to the curler causes heat to flow into the curler, heating the resilient sheet and coatings. The thermal mass of these elements keeps the curler heated for some period of time after the curler is removed from the heat source. By rolling the sheet to form a cylinder so that a portion of the sheet overlaps another portion of the sheet, and clipping the two portions together with a clip such as a bobby pin or the like, the cylinder's shape may be established and held with relative ease and simple adjustability of cylinder diameter. For storage, the sheets may be completely flattened for storage or transport in a very minimal volume.

10 Claims, 5 Drawing Sheets

HEATABLE HAIR CURLER WITH ADJUSTABLE DIAMETER

CROSS-REFERENCE TO RELATED APPLICATION

This application is a continuation-in-part of U.S. patent application Ser. Nos. 08/540,791, (now U.S. Pat. No. 5,694,954) and 08/540,790, filed Oct. 11, 1995 (now U.S. Pat. No. 5,662,128) in the name of the inventor hereof. The entirety of these applications are hereby incorporated herein by reference as if set forth fully herein.

BACKGROUND OF THE INVENTION

1. Field of the Invention

The present invention relates to heatable hair curlers for curling human hair. More particularly, the invention relates to a novel adjustable apparatus for curling hair with curlers of selected diameters which may be stored and carried in a small volume.

2. The Background Art

Hair curlers are well known. Such devices traditionally comprise a cylinder upon which hair is rolled or curled. Heat and/or hair spray or other hair products are often applied so that the hair takes on the shape of the curler and, when the curler is removed, the hair is still curled. It is often desirable to be able to adjust the diameter of a curler so that a small number of curlers may offer the capability of curling at a number of diameters. A number of adjustable diameter curlers are thus known in the art. U.S. Pat. No. 4,456,020 to van Deursen teaches an adjustable diameter curler. The van Deursen device comprises a pair of telescoping elongated tubes axially and rotatably movable relative to one another. A pair of nested larger diameter end caps is secured at each end of each tube with the roller generally resembling a spool. Each pair of end caps includes a first cap with spiralled cam slots radiating from its center and a second cap nested in the first with a plurality of corresponding or equal number of straight cam slots radiating from its center. The nesting caps are rotatable relative to each other and the caps at each end are connected together by a plurality of toothed elongated curler segments. Each segment has structure at each end cooperating with the cap slots such that by rotating the end caps in opposite directions the segments are radially cammed to change the curler roller diameter. Additional structure locks the cap rotation at any desired roller diameter.

U.S. Pat. No. 5,186,187 to Roberts teaches another adjustable diameter curler. Roberts' device provides for the use of a cylindrical tube rolled from a rectangular perforated sheet of flexible material, the sheet having an outer edge which overlaps a portion of the tube. The tube has a pair of opposing transverse edges, each of which is engaged within a spiral groove formed in opposing caps. The caps are rotationally mounted on an elongated shaft, such that rotation of the disks causes advancement of the transverse edges within the spiral groove, changing the diameter of the outer tube, as desired.

U.S. Pat. Nos. 5,020,552 and 4,856,542 to Hollenberg et al. teach a radially expandable hair curler comprising a generally cylindrical hollow body, a detachable holding strap stretching from one longitudinal end of the body to the other, and internal mechanical devices for expanding and contracting the curler body.

U.S. Pat. No. 4,270,555 to Punte teaches a hair curler that provides for a plurality of stages of hair curling with increasing wave lengths along the length of the hairs of the head. The hair curler may be used on short hair or very long hair. The multi-stages provide for a selectivity of lengths for short hair. The hair curler consists of a plurality of removably insertable curler components that nest one within the other in a manner similar to a telescoping mechanism. An elastic tie provides a means for securing the plurality of removably insertable components together and, at the same time, holds the hair in place on the curler. A port hole in one end provides a means for applying wave solution to the hair rolled on the interior of the roller, with communicating slots to permit the solution to seep through to the hair at the periphery of the spiraling rolls of hair.

U.S. Pat. No. 5,000,200 to Roberts provides for the use of a cylindrical tube rolled from a rectangular sheet of flexible material, the sheet having an outer edge which overlaps a portion of the tube. The tube has a pair of opposing transverse edges, each of which is engaged within a spiral groove formed in opposing end caps. The end caps are rotationally mounted on an elongated shaft, such that rotation of the caps causes advancement of the transverse edges within the spiral grooves, changing the diameter of the outer tube, as desired.

U.S. Pat. No. 3,232,300 to Fisher teaches an adjustable diameter hair curler formed of a sheet of soft plastic having an array of holes and a line of snap-type fasteners. The snaps mate with and penetrate a line of holes in the array to hold the sheet in the form of a cylinder. Diameter adjustment is accomplished by selecting another line of holes to apply the snaps to.

Non-adjustable fixed-diameter cylindrical hair curlers are known which include hook-type fasteners on the outer portion of the cylinder for engaging hair.

U.S. Pat. No. 4,584,462 to Morrison teaches a transportable heating unit for hair curlers which utilizes a heat sink core to heat a plurality of hair curler elements stored longitudinally adjacent to the heat sink core. The heat must pass through an insulating layer of the curler elements.

While the foregoing devices are fit for their intended purposes, there is room for improvement in portable, adjustable diameter heated hair curlers.

SUMMARY OF THE INVENTION

The present invention is directed to a novel heated adjustable diameter hair curler which is extremely lightweight, portable, suitable for travel, occupies little volume and which may be used with a wide variety of available heating sources. The novel adjustable curler comprises a thin sheet of a flexible resilient material such as a metal. The sheet has a first planar side and a second planar side opposite the first planar side. At least one of the first and second planar sides is coated with a soft high temperature rubber material. This side engages the hair. The opposite planar side may also be coated with a soft high temperature rubber material, or, alternatively, with another flexible high temperature material. Application of heat from a heat source to the curler ("heating phase") causes heat to flow into the curler, heating the metal sheet and coatings. The thermal mass of these elements keeps the curler heated for some period of time after the curler is removed from the heat source. By rolling the sheet to form a cylinder so that a portion of the sheet overlaps another portion of the sheet ("overlap"), and clipping the two portions together with a clip such as a bobby pin or the like, the cylinder's shape may be established and held with relative ease and simple adjustability of cylinder diameter. For storage, the sheets may be completely flattened for storage or transport in a very minimal volume.

According to another aspect of the present invention, a tapered end is provided to one end of the sheet so that when the sheet is rolled into a cylindrical form, the "step" formed at the overlap is reduced or eliminated to avoid imprinting this step onto the hair.

According to another aspect of the present invention, a series of guides or holes are provided through the sheet including a first guide at a first end of the sheet extending horizontally through the sheet and a series of other parallel guides extending horizontally through the sheet, at locations intermediate the two ends of the sheet, so that a clip or pin such as a bobby pin may be used to clip two such guides together at an overlap to hold the cylindrical shape of the curler.

According to another aspect of the present invention, a clip or pin, slidable in the first guide, but not easily removable from the guide and being essentially permanently disposed therein, is provided to clip two guides together at an overlap without the need to use a separate pin or clip.

OBJECTS AND ADVANTAGES OF THE INVENTION

Accordingly, it is an object of the present invention to provide a novel hair curler.

It is a further object of the present invention to provide a novel hair curler which is heatable and adjustable in diameter.

Another object of the present invention is to provide an adjustable diameter heatable curler which may be stowed in a small volume suitable for travel.

These and many other objects and advantages of the present invention will become apparent to those of ordinary skill in the art from a consideration of the drawings and ensuing description of the invention.

DESCRIPTION OF THE PREFERRED EMBODIMENTS

Those of ordinary skill in the art will realize that the following description of the present invention is illustrative only and is not intended to be in any way limiting. Other embodiments of the invention will readily suggest themselves to such skilled persons from an examination of the within disclosure.

The use of hair curlers to curl hair for cosmetic purposes is well known in the art. Such prior art curlers offer a number of drawbacks. When fixed diameter curlers are used, they are frequently voluminous to store or transport as a large number of curlers may be needed at any one time, and a complete set at each desired diameter may be required for full flexibility. Adjustable diameter curlers are often complex mechanisms which may be difficult to manipulate and which often do not store in a flat configuration so that storage in a small volume is possible. Such small volume storage is highly desirable for travel, or servicing customers away from the hair salon. The present invention resolves these drawbacks with elegant simplicity.

Figure 1:
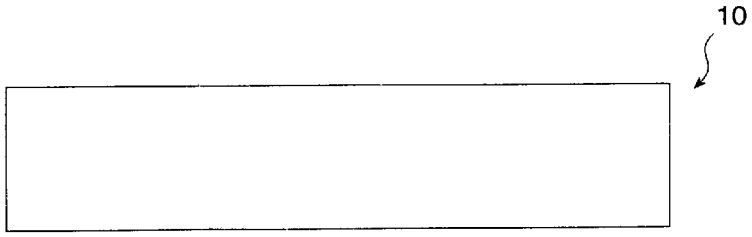
FIG. 1 is a top plan view of the hair curler according to a presently preferred embodiment of the present invention.
Figure 2:
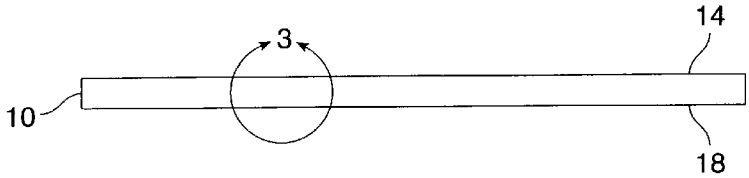
FIG. 2 is a side view of the hair curler according to a presently preferred embodiment of the present invention.
Figure 3:
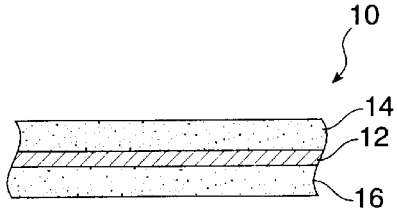
FIG. 3 is a cross-sectional view taken along line 3—3 of FIG. 2 showing the inside structure of the hair curler apparatus according to a presently preferred embodiment of the present invention.

According to a presently preferred embodiment of the present invention, the adjustable curler comprises a thin flexible rectangular curler sheet 10 as shown in FIGS. 1 and 2. Turning now to FIG. 3, curler sheet 10 preferably comprises a thin resilient sheet 12 having a first coating 14 and a second coating 16. Resilient sheet 12 is preferably formed of a rectangular piece of spring steel to the desired length and width. The presently preferred thickness range is 0.001"–0.025" with 0.002" being presently most preferred. First and second coatings 14, 16 surround resilient sheet 12 in a preferred embodiment. Presently preferred for coatings 14, 16 is a high temperature silicone rubber or silicone foam rubber material yielding an overall thickness to the curler sheet 10 of approximately 0.050" in the most preferred embodiment. An overall thickness range of 0.020"–0.150" is also presently preferred. Other materials would work for coatings 14, 16, the key being that first coating 14, which contacts the hair, be soft and able to withstand repeated heat cycling to 100° C. and that second coating 16, which does not contact the hair, simply be flexible and able to withstand repeated heat cycling to 100° C.

It is desirable that resilient sheet 12 be flexible, yet resilient, so that when bent, it attains a cylindrical shape rather than a folded shape. Resilient sheet 12 thus acts as a spring to bias the curler sheet 10 toward a flat orientation as shown in FIG. 2 which is particularly advantageous when the curler sheets are to be stored. When curled, resilient sheet 12 helps curler sheet 10 attain a cylindrical shape through the uniform bias that it applies along its length.

Resilient sheet 12 is formed in any of a number of conventional manners, such as by cutting from a strip of like material. Such material is commercially available from a wide variety of sources. The rubber used in coatings 14, 16 is also available from a wide variety of commercial sources and may be applied by dipping, painting, spraying or other conventional coating processes.

Figure 4:
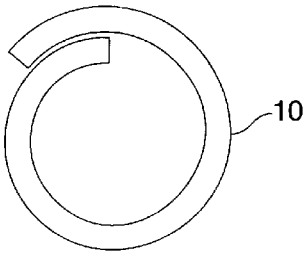
FIG. 4 is a view looking down the cylindrical form of the adjustable diameter hair curler according to a presently preferred embodiment of the present invention.

FIG. 4 is a view looking down the cylindrical form of the curler sheet 10 according to a presently preferred embodiment of the present invention.

Figure 5:
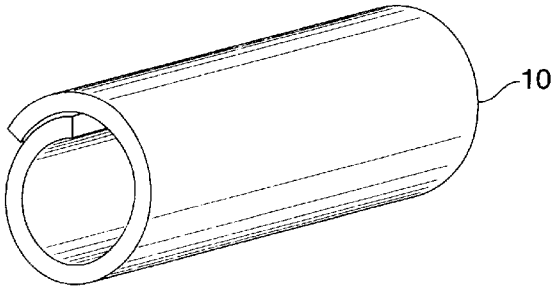
FIG. 5 is a perspective view of the cylindrical form of the adjustable diameter hair curler according to a presently preferred embodiment of the present invention.

FIG. 5 is a perspective view of the cylindrical form of the curler sheet 10 according to a presently preferred embodiment of the present invention.

Figure 6:
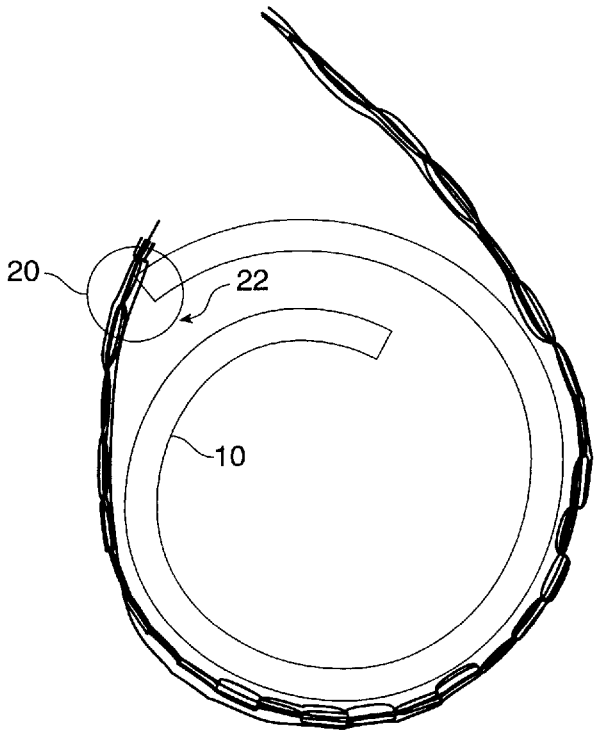
FIG. 6 is a view looking down the cylindrical form of the adjustable diameter hair curler with hair wrapped around the curler according to a presently preferred embodiment of the present invention.

FIG. 6 is a view looking down the cylindrical form of the curler sheet 10 with hair wrapped around the curler according to a presently preferred embodiment of the present invention. The rubber material of which coatings 14 and 16 is formed is soft and thus does not harm the hair while making it easy to wrap the hair about it.

Figure 7:
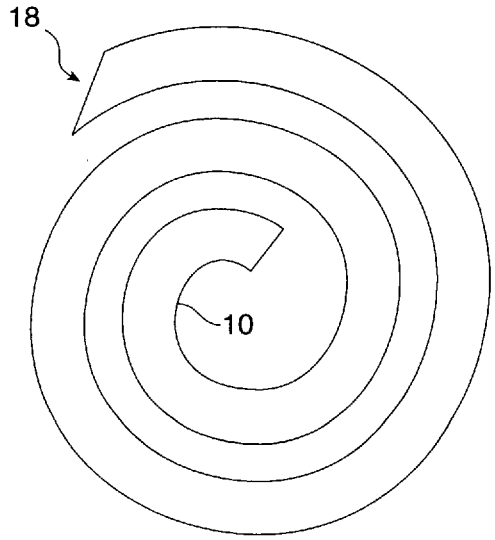
FIG. 7 is a view looking down the cylindrical form of the adjustable diameter hair curler according to another presently preferred embodiment of the present invention wherein at least one end of the curler is tapered.

FIG. 7 is a view looking down the cylindrical form of the curler sheet 10 according to another presently preferred embodiment of the present invention wherein at least one end 18 of the curler sheet 10 is tapered so that when the sheet is rolled into a cylindrical form, the "step" (20 in FIG. 6) formed at the overlap (22 in FIG. 6) is reduced or eliminated to avoid imprinting this step onto the hair.

Figure 8:
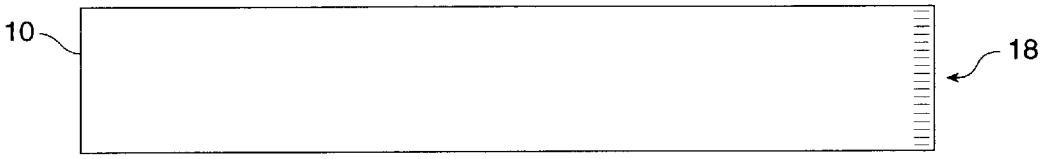
FIG. 8 is a top plan view of a presently preferred embodiment of the present invention wherein at least one end of the curler is tapered.

FIG. 8 is a top plan view of a presently preferred embodiment of the present invention wherein at least one end 18 of the curler sheet 10 is tapered.

Figure 9:
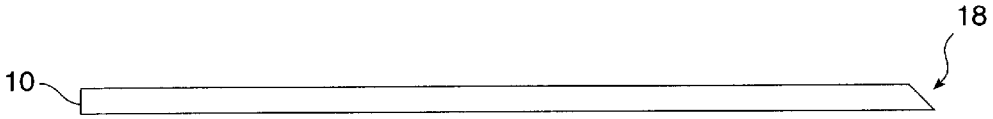
FIG. 9 is a side view of a presently preferred embodiment of the present invention wherein at least one end of the curler is tapered.

FIG. 9 is a side view of a presently preferred embodiment of the present invention wherein at least one end 18 of the curler sheet 10 is tapered.

According to another aspect of the present invention, a series of guides, guide slots or holes may be used with clips either external to the hair curler or built in to be used with it so as to facilitate the clipping of the curler into a cylindrical form. Those of ordinary skill in the art will now realize that a number of different mechanisms can be used to achieve this advantage.

Figure 10:
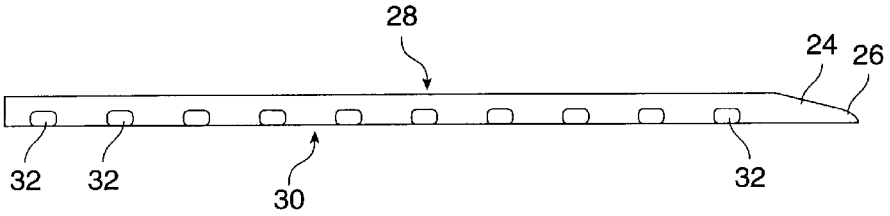
FIG. 10 is a side view of another presently preferred embodiment of the present invention wherein a second side of the curler sheet includes a series of slots or holes to facilitate clipping.
Figure 11:
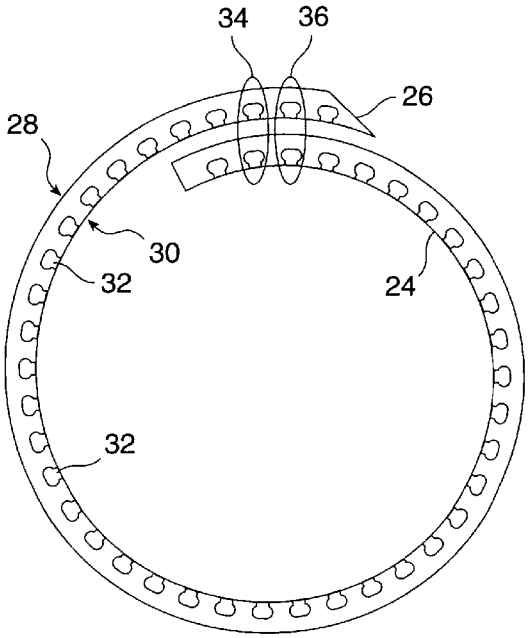
FIG. 11 is a view looking down the cylindrical form of the adjustable hair curler of FIG. 10.

In FIG. 10, a curler sheet 24 is shown having a tapered edge 26 and a first side 28 and a second side 30. First side is preferably formed of a soft rubber-like material as discussed above. Second side 30 is preferably formed of a harder material such as a moldable plastic. According to this preferred embodiment of the present invention, a plurality of guide slots 32 are formed horizontally through second side 30 at a number of locations intermediate the two ends of the sheet as shown in FIGS. 10 and 11. These guide slots may accommodate a bobby pin or other clip when the curler sheet 24 is rolled into the cylindrical form shown in FIG. 11 and one or more of the guide slots 32 are overlapped as at 34 or at 36. Guide slots 32 may be replaced with holes or other shaped apertures capable of retaining the clip in use.

Figure 12:
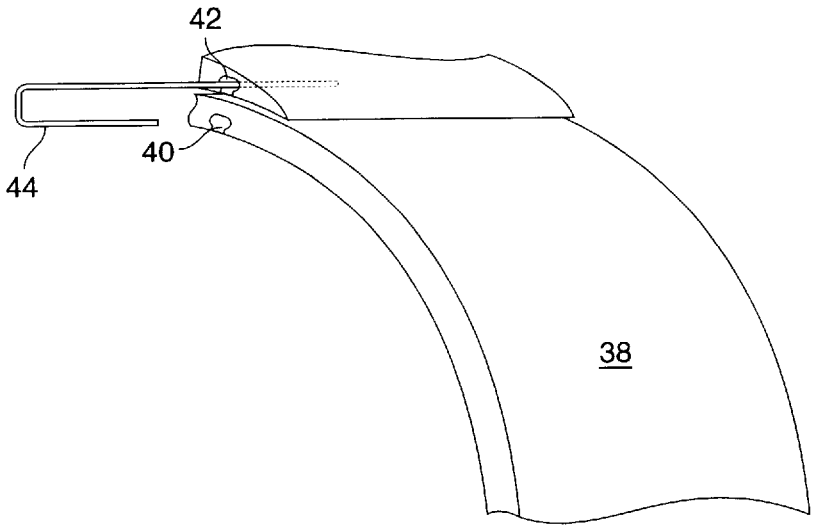
FIG. 12 is a partial perspective view of the hair curler according to a presently preferred embodiment of the present invention showing a retaining clip in a disengaged position.
Figure 13:
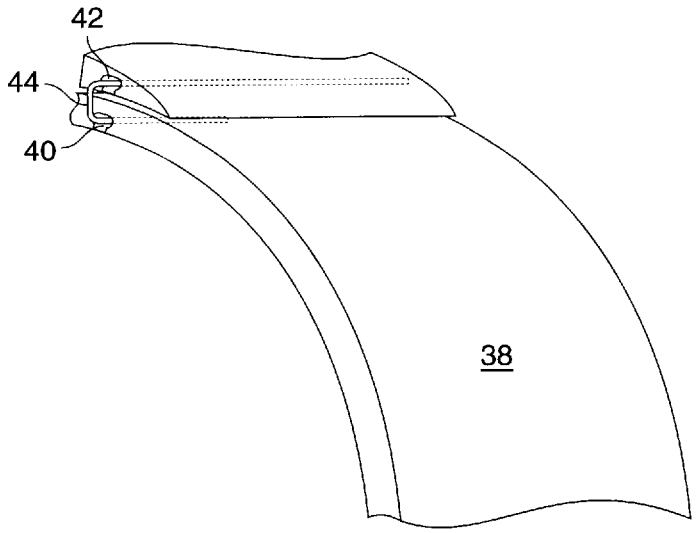
FIG. 13 is a partial perspective view of the hair curler according to a presently preferred embodiment of the present invention showing a retaining clip in an engaged position.
Figure 14:
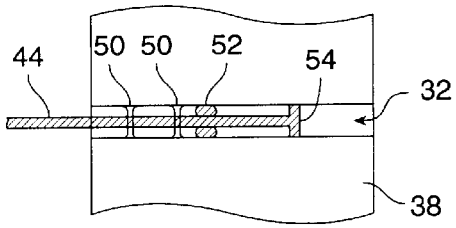
FIG. 14 is a diagram showing a permanent clip installed in a guide slot of a hair curler in accordance with a presently preferred embodiment of the present invention.
Figure 15:
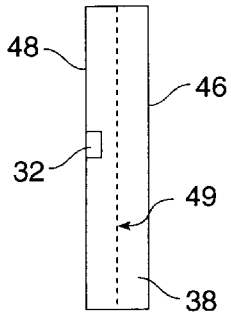
FIG. 15 is a diagram showing a guide slot of a hair curler in accordance with a presently preferred embodiment of the present invention.

According to another presently preferred embodiment of the present invention as shown at FIGS. 12 and 13, a curler sheet 38 incorporating guide slots 40, 42 also incorporates a clip 44 which may be retained in guide slot 42 when disengaged as shown in FIG. 12. FIG. 13 shows the positioning of clip 44 when engaged. In this embodiment, clip 44 need not be longer than the width of curler sheet 38. Turning now to FIGS. 14 and 15 a clip 44 is shown in a guide slot 32 of curler sheet 38 having a first side 46 for engagement with hair, a second side 48, and a resilient sheet 49 embedded therein. One way of implementing the guide slot concept is to form slots 32 in side 48 as shown. Cross bars 50 retain clip 44 in guide slot 32. Blockage 52 works in conjunction with clip end 54 to-keep clip 44 from coming totally out of guide slot 32, if desired.

Figure 16:
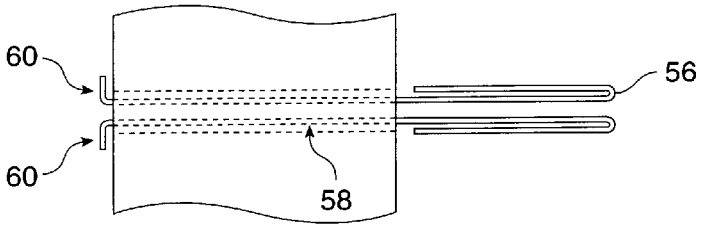
FIG. 16 is a top plan view showing a permanent clip installed in a guide slot of the hair curler sheet.
Figure 17:
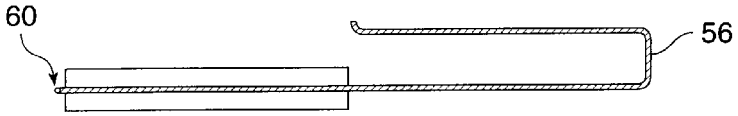
FIG. 17 is a cross sectional view showing a permanent clip installed in a guide slot of the hair curler sheet.
Figure 18:
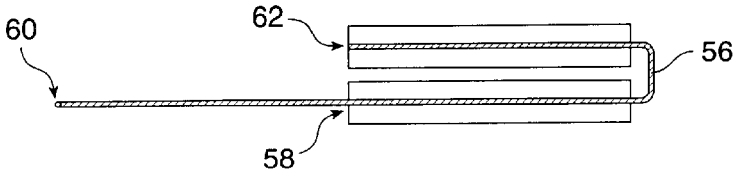
FIG. 18 is a cross sectional view showing a permanent clip installed in a guide slot of the hair curler sheet and holding that guide slot to another guide slot.

According to another presently preferred embodiment of the present invention shown at FIGS. 16, 17 and 18, a pin 56, slidable in a first guide slot 58, but not easily removable from guide slot 58, and preferably held in place by a bent portion 60, is provided to clip two guide slots 58, 62 together at an overlap without the need to use a separate pin or clip.

According to yet another presently preferred embodiment of the present invention, the resilient sheet 12 may be shorter in length than coatings 14 and 16 allowing a portion of curler sheet 10 formed on only coatings 14 and 16 to wrap at least partially about itself to assist in forming a cylindrical curler which holds its shape.

While illustrative embodiments and applications of this invention have been shown and described, it would be apparent to those skilled in the art that many more modifications than have been mentioned above are possible without departing from the inventive concepts set forth herein. The invention, therefore, is not to be limited except in the spirit of the appended claims.

What is claimed is:

1. An adjustable diameter hair curler comprising:

a flat sheet of a resilient, flexible metallic material, said sheet having a first planar side and a second planar side; and a coating of a soft, heat resistant rubber material completely covering said sheet.

2. An adjustable diameter hair curler according to claim 1 further comprising:

means for removably connecting a first portion of said sheet to a second portion of said sheet to form a cylindrical curler.

3. An adjustable diameter hair curler according to claim 2 further comprising a tapered end disposed at said second end.

4. An adjustable diameter hair curler comprising:

a flat sheet of a resilient, flexible metallic material, said sheet having a first planar side and a second planar side;

a first coating of a soft, heat resistant rubber material completely covering said first planar side; and a second coating of a heat resistant material substantially covering said second planar side.

5. An adjustable diameter hair curler according to claim 4 further comprising:

means for removably connecting a first portion of said sheet to a second portion of said sheet to form a cylindrical curler.

6. An adjustable diameter hair curler according to claim 5 further comprising a tapered end disposed at said second end.

7. An adjustable diameter hair curler comprising:

a sheet of a resilient flexible material biased toward a flat shape, said sheet having a first planar side, a second planar side opposite said first planar side, a first end and a second end disposed opposite said first end;

a first coating of a soft, heat resistant rubber material completely covering said first planar side; and a second coating of a heat resistant material substantially covering said second planar side.

8. A hair curler according to claim 7 wherein the curler, at one end, tapers from a first thickness to zero thickness.

9. A hair curler according to claim 7 further comprising a plurality of guide slots disposed horizontally through said second coating and arranged so that a pair of selected guide slots may be clipped together to form the hair curler into a cylindrical shape.

10. A hair curler according to claim 9 further comprising a clip permanently and slidably disposed in a first of said pair of selected guide slots for clipping a second of said pair of selected guide slots to said first of said pair of selected guide slots.

* * * * *